US009010549B2

(12) United States Patent
Krohn

(10) Patent No.: US 9,010,549 B2
(45) Date of Patent: Apr. 21, 2015

(54) WARDROBE LIFT WITH EXTENDED LOWERING CAPABILITY

(71) Applicant: Kurtis Roland Krohn, Mooresville, NC (US)

(72) Inventor: Kurtis Roland Krohn, Mooresville, NC (US)

( * ) Notice: Subject to any disclaimer, the term of this patent is extended or adjusted under 35 U.S.C. 154(b) by 27 days.

(21) Appl. No.: 13/662,433

(22) Filed: Oct. 27, 2012

(65) Prior Publication Data

US 2014/0116968 A1 May 1, 2014

(51) Int. Cl.

| | |
|---|---|
| ***A47F 3/08*** | (2006.01) |
| ***A47B 61/02*** | (2006.01) |
| *A47F 7/00* | (2006.01) |
| *A47H 1/00* | (2006.01) |
| *B66D 1/36* | (2006.01) |
| *H02P 1/04* | (2006.01) |
| *G05B 5/00* | (2006.01) |

(52) U.S. Cl.
CPC ..... *A47B 61/02* (2013.01)

(58) Field of Classification Search
CPC ..... A47B 61/02; A47B 61/003; A47G 25/06; A47F 3/08
USPC ..... 211/87.01, 94.03, 96, 99, 100, 101, 211/102, 104, 119.01–119.13, 1.51, 1.52, 211/1.54, 1.56, 1.57, 85.3; 254/278, 283, 254/284, 285, 286; 318/9, 10, 14, 466, 468, 318/470, 443, 445; 190/13 R, 15 R
See application file for complete search history.

(56) References Cited

U.S. PATENT DOCUMENTS

| | | | | | |
|---|---|---|---|---|---|
| 605,884 | A | * | 6/1898 | Lancaster | 414/560 |
| 711,850 | A | * | 10/1902 | Hamilton | 160/71 |
| 730,228 | A | * | 6/1903 | Bump | 37/394 |
| 760,835 | A | * | 5/1904 | Ziegler | 211/100 |
| 842,188 | A | * | 1/1907 | Enggren | 211/119.07 |
| 871,343 | A | * | 11/1907 | Ketcham | 254/283 |
| 1,005,047 | A | * | 10/1911 | Linder | 211/94.03 |
| 1,030,493 | A | * | 6/1912 | Borenson | 160/58.1 |
| 1,236,169 | A | * | 8/1917 | Hentnik | 211/96 |
| 1,248,173 | A | * | 11/1917 | Schubeman | 211/119.08 |
| 1,338,266 | A | * | 4/1920 | Trach | 211/119.08 |
| 1,422,061 | A | * | 7/1922 | Hughes | 211/94.03 |
| 1,490,485 | A | * | 4/1924 | Roziger | 211/119.07 |
| 1,545,923 | A | * | 7/1925 | Pieterick | 211/94.03 |
| 1,641,106 | A | * | 8/1927 | Van Duzer | 211/119.08 |
| 1,836,008 | A | * | 12/1931 | Anzalone | 211/94.03 |
| 1,888,612 | A | * | 11/1932 | Anderson | 74/89.22 |
| 2,638,230 | A | * | 5/1953 | Cadman | 211/94.03 |
| 2,736,438 | A | * | 2/1956 | Frey | 211/104 |
| 2,875,903 | A | * | 3/1959 | Shourds | 211/100 |

(Continued)

*Primary Examiner* — Joshua J Michener
*Assistant Examiner* — Devin Barnett
(74) *Attorney, Agent, or Firm* — Harrington Law, P.C.; James M. Harrington

(57) ABSTRACT

An apparatus for raising and lowering a carrier for supporting clothes hangers or other hanging articles within a wardrobe closet that includes a tube, brackets for rotatable mounting of the tube, a tubular motor coupled to the tube for rotating the tube, and a base that attaches to a side panel of the wardrobe closet. Two arms each lie on a plane parallel to the base and to the side panel, attach at their ends to the carrier, and are mounted on the base so that they may oscillate and pivot in the plane between two positions, raising and lowering the carrier. At the lowest position the carrier releases from the arms and drop further. Fabric straps are wound onto and unwound from the tube to raise and lower the arms as the tube is rotated. A remote control receiver or programmable device may be used to control operation of the motor.

6 Claims, 3 Drawing Sheets

(56) References Cited

U.S. PATENT DOCUMENTS

| | | | | | |
|---|---|---|---|---|---|
| 3,677,521 | A * | 7/1972 | Kinnicutt, Jr. | 254/283 |
| 3,961,699 | A * | 6/1976 | Hirsch | 198/464.1 |
| 3,967,735 | A * | 7/1976 | Payne | 254/284 |
| 4,005,852 | A * | 2/1977 | Schmitmeyer et al. | 254/266 |
| 4,114,764 | A * | 9/1978 | Rich | 211/100 |
| 4,135,627 | A * | 1/1979 | McInerney | 212/299 |
| 4,296,819 | A * | 10/1981 | Griste | 173/147 |
| 5,019,126 | A * | 5/1991 | Post | 211/104 |
| 5,149,057 | A * | 9/1992 | Meurer | 254/276 |
| 5,439,121 | A * | 8/1995 | Agostoni | 211/100 |
| 5,695,072 | A * | 12/1997 | Terragni | 211/1.51 |
| 5,979,671 | A * | 11/1999 | Pan et al. | 211/1.57 |
| 6,149,020 | A * | 11/2000 | Gumpel et al. | 211/119.01 |
| 6,558,083 | B1 * | 5/2003 | Quandt | 405/218 |
| 6,592,101 | B2 * | 7/2003 | Vetesnik | 254/285 |
| 6,698,722 | B1 * | 3/2004 | Crawford | 254/284 |
| 6,991,064 | B2 * | 1/2006 | Ehrenleitner | 182/141 |
| 7,028,988 | B2 * | 4/2006 | Scott | 254/277 |
| 7,201,365 | B2 * | 4/2007 | Crawford | 254/284 |
| 7,416,169 | B2 * | 8/2008 | Noeske et al. | 254/275 |
| 7,527,243 | B2 * | 5/2009 | Blasek | 254/333 |
| 7,624,967 | B1 * | 12/2009 | Doebler et al. | 254/272 |
| 7,874,437 | B2 * | 1/2011 | Jones | 211/85.3 |
| 8,061,789 | B2 * | 11/2011 | Krueger | 312/248 |
| 8,073,569 | B2 * | 12/2011 | Decrooix et al. | 700/275 |
| 8,616,527 | B2 * | 12/2013 | Cho | 254/286 |
| 2002/0008230 | A1 * | 1/2002 | Hanamoto | 254/283 |
| 2004/0112853 | A1 * | 6/2004 | DeNatale, Jr. | 211/163 |
| 2005/0087731 | A1 * | 4/2005 | Scott | 254/283 |
| 2005/0280381 | A1 * | 12/2005 | Cavarec et al. | 318/162 |
| 2008/0029674 | A1 * | 2/2008 | Stearns | 248/329 |
| 2008/0296089 | A1 * | 12/2008 | Penn et al. | 182/142 |
| 2009/0005911 | A1 * | 1/2009 | Decroix et al. | 700/275 |
| 2010/0140194 | A1 * | 6/2010 | Krueger | 211/1.57 |
| 2011/0315642 | A1 * | 12/2011 | Gubbrud | 211/1.57 |
| 2012/0000865 | A1 * | 1/2012 | Cangialosi | 211/1.57 |
| 2012/0248046 | A1 * | 10/2012 | Warner | 211/1.57 |
| 2012/0312760 | A1 * | 12/2012 | Larson | 211/1.51 |
| 2013/0264300 | A1 * | 10/2013 | Shaffer et al. | 211/117 |

* cited by examiner

WARDROBE LIFT WITH EXTENDED LOWERING CAPABILITY

BACKGROUND

1. Field of the Invention

The present invention relates to closet space storage and increased functionality of home wardrobe storage. It relates in general to closet space that is typically out of reach for most people. More particularly the invention relates to wardrobe lifts with pivoting or oscillating arms that raise and lower hanging clothes using a motor driven means. This invention takes the wardrobe lift a step further by creating a simple way to extend greatly the lowering capability of a lift with rotating arms.

2. Description of Prior Art and Advantages

A variety of wardrobe lifts are known and have been used for several years. They typically consist of two rotating arms that pivot up and down at least 90 degrees and have a clothes rail or pole that fits between the arms and holds clothes that are on hangers. For example U.S. Pat. No. 2,875,903, U.S. Pat. No. 4,114,764, U.S. Pat. No. 5,439,121 all disclose wardrobe lifts that raise and lower hanging clothing in a manual fashion. The U.S. Pat. No. 5,695,072, U.S. Pat. No. 7,874,437_1 and Pub. No DE 203 04 657 U1 disclose a motorized wardrobe lift but they do not have any extended lowering but only a 90 degree rotation of the clothes rail via the rotating arms. U.S. Pat. No. 8,061,789 B2 does have an extended lowering capability however it uses a much different design that uses three pulleys per rotating arm in order to lower the clothes rail and this invention only uses one pulley per rotating arm and a receptacle that holds and releases a carrier means. Also this invention uses no rigid rod between the rotating arms and no cable as described in U.S. Pat. No. 8,061,789.

Overall this invention is a superior technique for raising and lowering clothes to any level that is required by the user.

SUMMARY OF THE INVENTION

A wardrobe lift that in accordance with the invention includes a tube, a motor coupled within the tube for rotating the tube, a plurality of straps secured to the tube and two rotating arms that pivot a little past 90 degrees within a housing and hold a carrier means suitable for hanging clothes and other hanging objects. The motor turns the tube which rolls up the straps which raises and lowers the carrier means. The carrier means is lowered at first by the rotating arms that move the carrier means out and down in a circular fashion. The rotating arms are stopped from travel at approximately at a little past 90 degrees by the rotating arm housing. At this time the carrier means drops down from the rotating arms and continues to lower until stopped by the lower limit of the motor. To raise the carrier means the process is simply reversed. It is also possible to have the carrier means hold any type of storage device such as a cabinet that can rotate or move freely as it is hung from the carrier means.

In an aspect of the invention the rotating arms have a receptacle for holding and releasing the carrier means and a pulley on the receptacle so that the lifting straps can slide over the ends of the rotating arms as they raise and lower the carrier means from the receptacle.

In an aspect of the invention the motor is a tubular motor which resides inside a tube and at the ends of the tube, lifting straps are wound.

In an aspect of the invention the motor includes limit setting capabilities that allow the carrier means to start and stop its movement at predetermined and repeatable positions.

In an aspect of the invention, the motor is coupled to a On-Off-On switch that controls the movement of the carrier means.

In an aspect of the invention, the motor is coupled to a remote control receiver that controls the motor in response to signals received from a remote control transmitter.

In an aspect of the invention, the apparatus includes a programmable device coupled to the motor that controls operation of the motor in response to its programming.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

DETAILED DESCRIPTION OF THE PREFERRED EMBODIMENTS

Figure 1:
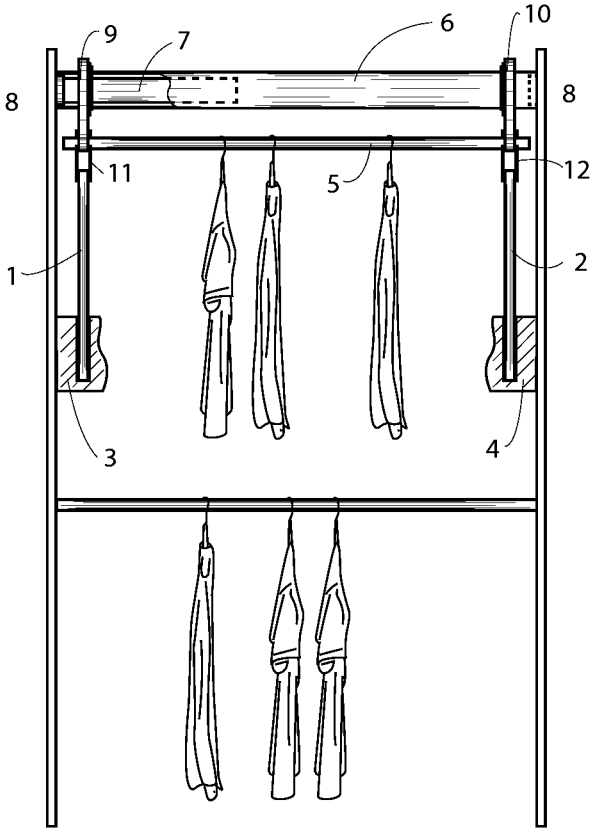
FIG. 1 is a front view of a wardrobe lift according to the present invention.

FIG. 1 illustrates the wardrobe lift which includes a left side rotating arm 1 and a right side rotating arm 2. These arms are connected to a left side base assembly 3 and a right side base assembly 4. These parts can be made out of wood, metal or any strong attractive material. The base assemblies 3, 4 can be attached to the sides of a clothes closet or the side panels of a typical standard shelving system and their purpose is to mount the wardrobe lift and to contain the rotating arms 1 and 2. At the top of FIG. 1 is shown a carrier means 5 for hanging clothes. The carrier means 5 is basically a standard closet rod for hanging clothes but could also be replaced by a shelving structure or cabinet structure that could hold and carry any objects. Behind the carrier means 5 is a hollow tube 6 typically made out of aluminum. Inside the tube 6 is a tubular motor 7 which is a cylindrically shaped low rpm gear motor. It has attached to it a conventional drive cap (not shown) which also resides within the tube 6 and is attached to the tube in conventional fashion, such as with screws, rivets, adhesive, welding or the like (none of which is shown). The drive cap purpose is to rotate the tube 6 and is driven by the motor 7. The tubular motor 7 and the tube 6 and the drive cap (not shown) are available from SOMFY Systems, 47 Commerce Drive, Cranbury, N.J. 08512 but could also be sourced from other manufacturers. The tube 6 reaches from one side of the closet partition to the other side of the closet partition and is attached with brackets 8 that allow it to turn and rotate as it is driven by the tubular motor 7. The tube 6 will automatically rotate and thus raise and lower the arms 1 and 2 utilizing a one inch wide left fabric lifting strap 9 and a one inch wide right fabric lifting fabric strap 10. A left receptacle 11 and a right receptacle 12 hold the cloths rail 5.

Figure 2A:
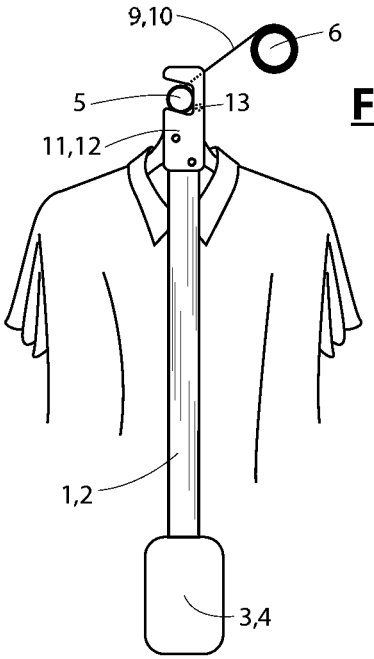
FIG. 2A is a side view of a wardrobe lift according to the present invention in the upright position.

FIG. 2A shows a side view of the rotating arms 1,2 and the base 3,4 and they are shown in the upright position. Attached between the arm 1,2 and the tube 6 is the straps 9,10 which are made from a strong piece of flat fabric approximately 1 inch wide. It has the look and feel of an automobile seat belt strap except that it is less wide. When the rotating arms 1,2 is in the upright position the straps 9,10 are wrapped around the tube 6. The color for the straps 1,2 would most likely be black.

Figure 2B:
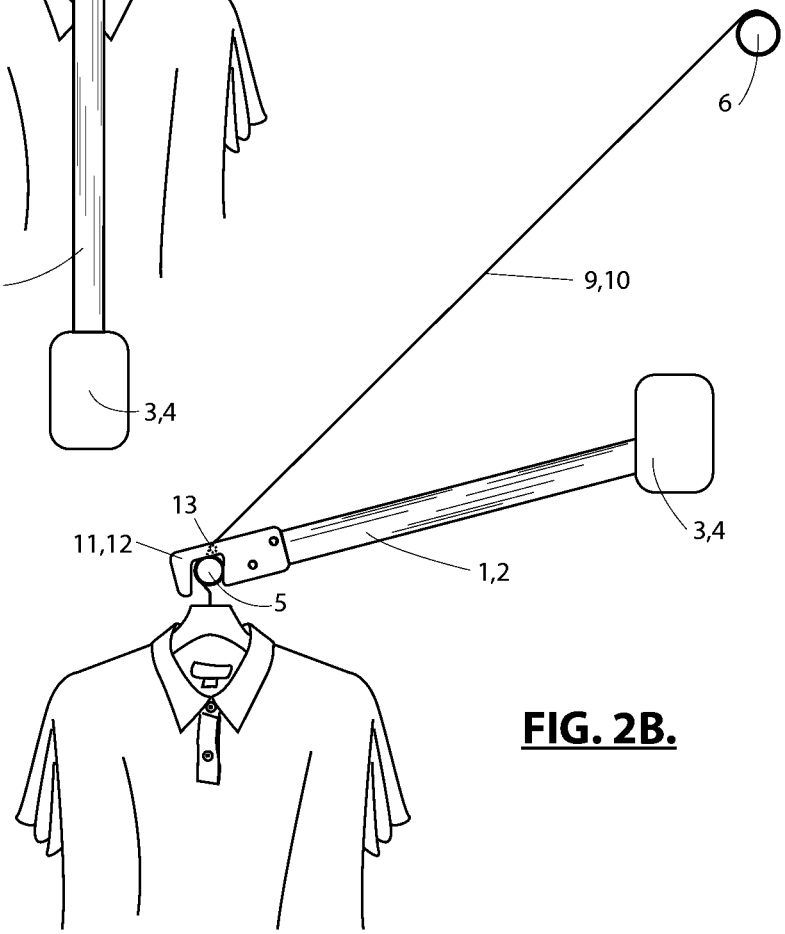
FIG. 2B is a side view of a wardrobe lift according to the present invention in the lowered position.

FIG. 2B shows the same side view of the rotating arms 1,2 and the base 3,4 and they are shown in the middle position. The position of the rotating arms 1,2 is as low as they are permitted to go as they are stopped by the design of the base 3,4 that blocks further downward travel. Also shown in FIG. 2A is the receptacle 11,12, the clothes rail 5 and a pulley 13.

Figure 2C:
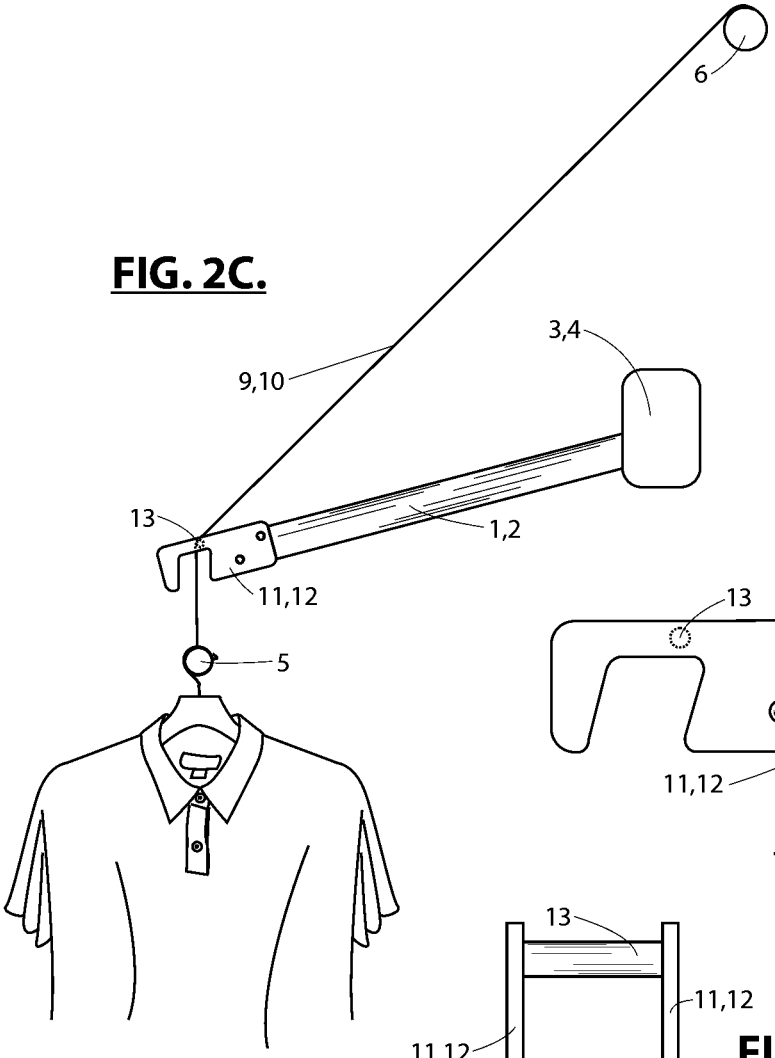
FIG. 2C is a side view of a wardrobe lift according to the present invention in the extended position.

FIG. 2C shows the same side view of the rotating arms 1,2 and the base 3,4 and they are shown in the lowered position. Also shown in FIG. 2C is the receptacle 11,12, the clothes rail 5 and a pulley 13. The pulley 13 makes contact with the lifting straps 9,10 and enables them to lower effectively even as the rotating arms 1,2 have stopped moving due to being blocked by the design of the bases 3,4.

Figure 3A:
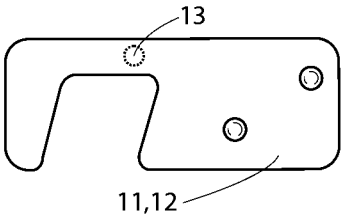
FIGS. 3A-3B are side and front detail views, respectively, of a receptacle for the clothes rail according to the present invention.
Figure 3B:
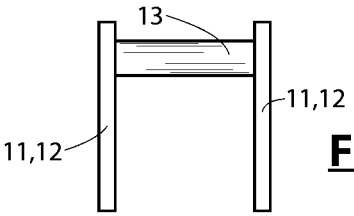

FIGS. 3A-3B show the clothes receptacle 11,12 and the pulley 13. The clothes receptacle 11,12 has two identical plates that are separated by the pulley 13. The lifting strap (not shown in these figures) rides over the top of the pulley.

A basic operating switch with enclosure for the wardrobe lift and tubular motor is not shown in any Figure but can be located anywhere. When installed the wardrobe lift would become a semi-permanent fixture of the home or building.

Operation

An important purpose of the invention is to create more usable closet storage space and also increase the ease of selection when removing items from storage that is otherwise out of reach in the home or business. The invention is basically an electric motor driven lift that utilizes a tubular motor 7 (FIG. 1,2A) and can raise and lower a carrier means 5 (FIG. 1, 2A, 2B, 2C) that pivots or oscillates approximately 100 degrees and then leaves the clothes rail receptacle 11,12 (FIG. 1, 2A, 2B, 2C, 3A, 3B) and lowers further so that the user can reach the clothes. Typically clothes would hang from the carrier means 5 but a shelf type structure or light weight cabinet that hangs freely from the carrier means 5 can also be incorporated into the design. The motion of the carrier means 5 can be accomplished without encroaching on the space below because of the unique pivot point of the rotating arms. This pivot point allows the rotating arms 1, 2 (FIG. 1, 2A, 2B, 2C) to lower storage and move it out so that it can be displayed in front of stationary storage that is below the bottom of the rotating arms 1, 2.

The wardrobe lift is driven by flat fabric straps 9,10 (FIG. 1, 2A, 2B, 2C) that are wrapped around each end of the tube 6 (FIG. 1, 2A) that contains the tubular motor 7. The motor 7 turns the tube 6 from within the tube 6 and the tube wraps the fabric straps 9 around the tube 6 as it turns. The straps 9,10 wrap around each other in circular fashion with each rotation increasing the diameter of the rolled up straps. When the fabric straps 9 are wound up they will have wrapped around the tube about 5 or 6 times and the rotating arms 1, 2 (FIG. 1, 2A, 2B, 2C, 3) will be in the up position. When the tube 6 turns the opposite way the fabric straps 9,10 unwind and the rotating arms 1, 2 move to the down position. The base 3,4 holds a spring assembly (not shown) that forces the rotating arms 1,2 to move to a downward position until gravity can take over. As the rotating arms 1,2 move down, the receptacle 11,12 (FIG. 1, 2A, 2B, 2C, 3) holds the carrier means by a slot in the receptacles 11,12. The angle of the slot holds the carrier means in place until the rotating arms have sufficient gravitational force and lifting angle to keep the carrier means in the receptacle. As the rotating arms 1,2 continue to move past 90 degrees until the bases 3,4 (FIG. 1, 2A, 2B, 2C) block further downward travel at about 100 degrees. At this point the tube 7 keeps turning and the straps 9,10 keep unraveling and the carrier means 5 drops out of the receptacle 11,12. The straps 9,10 are riding on top of the pulley 13 that is above the slot in the receptacles 11,12 and the carrier means 5 continues to lower as the tube turns and the rotating arms remain temporarily stationary. The carrier means continues to lower until it is approx 20 to 30 inches lower than the receptacle 11,12. This allows for easy access to the carrier means 5 for the user.

After the user accesses the carrier means the switch can be moved to the up position and the tube 6 will start to rotate in the opposite direction. The lifting straps 9,10 will wind around the tube 6 and the carrier means 5 will rise and go in the upward direction. The lifting straps 9,10 will ride over the pulley and the rotating arms 1,2 will remain stationary due to the angle of their position that is determined by the bases 3,4. When the carrier means rises to the receptacle 11,12 it will enter the slot in the receptacle and the rotating arms 1,2 will begin to rise and rotate while holding the carrier means. This travel will continue until the rotating arms are in the upright position.

The wardrobe lift is operated by an On-Off-On switch (not shown) that could be either a momentary switch or a maintained switch. The unit has basically 2 positions. In the upright position, the rotating arms 1, 2 (FIG. 1, 2A, 2B, 2C, 3) are vertical and the items are being stored are out of reach. In the down position the rotating arms 1, 2 have traveled 100 degrees from the upright position and the carrier means 5 has dropped further via the pulley 13 that is a part of the receptacle 11,12 that is attached to the rotating arms 1,2. The stored items are now at a reachable level and are positioned in front of other stationary storage that could be below the wardrobe lift. The switch is used to turn on and off the tubular motor 7 (FIG. 1) and move the rotating arms 1, 2 between the two positions. The tubular motor 7 also has built-in limit switches (not shown)\and they are standard on most tubular motors 7. These limit switches ensure that the motor turns off automatically when it reaches the down position and turns off automatically when it reaches the up position. These limits are set before the wardrobe lift is shipped to a customer or they can be set during installation.

The tubular motor 7 (FIG. 1) may illustratively be powered by any conventional power source, such as AC, DC, battery or solar panels. The wardrobe lift may alternatively or additionally include a remote control receiver (not shown) coupled to the tubular motor 7. A user then uses a corresponding transmitter (not shown) to communicate with the remote control receiver to cause it to energize and de-energize the tubular motor 7 in the appropriate directions to wind and unwind fabric lifting straps 9,10 The wardrobe lift may also include a programmable control device, such as a microcomputer (not shown), that is programmed to control tubular motor 7, such as by having pre-sets programmed therein to raise and lower the rotating arms 1, 2 semi-automatically to any desired height. All of the above are optional equipment available from most tubular motor manufacturers such as SOMFY.

I claim:

1. A wardrobe lift for raising and lowering a carrier rod for supporting hanging clothes articles within a wardrobe closet, comprising:

a carrier rod;

a hollow motor tube having a pair of brackets at distal ends of the motor tube for mounting the motor tube between opposing side walls of the wardrobe closet;

a motor stored within the motor tube, wherein the motor rotates the motor tube about a horizontal axis; a pair of bases each attached to a corresponding side wall of the wardrobe closet;

an arm extending from each base parallel to the corresponding side walls of the wardrobe closet, each arm including a distal end and a proximal end; each of the arms being pivotable about an axis at the bases at the proximal end of each arm in order to raise and lower the distal ends of each arm between a raised and a lowered position;

a receptacle attached to the distal end of each of the arms, each receptacle has a slot forming an opening at an edge of each receptacle for receiving the carrier rod within the slot; and a plurality of straps for supporting the carrier rod, each strap being connected to the carrier rod at one end and wound about the motor tube at the other end, the straps being selectively windable and unwindable about the motor tube as the motor tube rotates to increase or decrease a length of each strap extending from the motor tube;

wherein the slots are angled to support and retain the carrier rod in the raised position and to release the carrier rod by gravity in the lowered position.

2. A wardrobe lift according to claim 1, wherein the pivoting of the arms below a selected point is restricted.

3. A wardrobe lift according to claim 2, wherein the straps each have a length that is sufficient to permit the carrier rod to be lowered below the selected point after the carrier rod is released from the slots of the receptacles as the motor tube rotates in one direction.

4. A wardrobe lift according to claim 3, wherein the receptacles each further comprise a pulley for directing the path of each strap after the carrier rod is released from the slots of the receptacles.

5. A wardrobe lift according to claim 1, further comprising:

a remote control transmitter and a remote control receiver for transmitting and receiving control signals for the motor.

6. A wardrobe lift according to claim 5, further comprising:

a programmable controller for controlling operation of the motor in response to programming and control signals.

* * * * *